US005316412A

United States Patent [19]

Sondergard

[11] Patent Number: 5,316,412

[45] Date of Patent: May 31, 1994

[54] REMOTE CONTROLLED UNDERWATER JOINT AND CRACK SEALING

[75] Inventor: Kenneth B. Sondergard, Redmond, Wash.

[73] Assignee: The United States of America as represented by the Secretary of the Army, Washington, D.C.

[21] Appl. No.: 880,377

[22] Filed: May 8, 1992

[51] Int. Cl.[5] ..... B63C 11/10

[52] U.S. Cl. ..... 405/169; 405/190; 405/191

[58] Field of Search ..... 405/158, 157, 168.1, 405/169, 190, 191

[56] References Cited

U.S. PATENT DOCUMENTS 4,436,449 3/1984 Smoot et al. ..... 405/158 X
4,444,528 4/1984 Scodino et al. ..... 405/158 X
4,718,459 1/1988 Adorjan ..... 405/158 X
4,720,213 1/1988 Gernhardt et al. ..... 405/190
4,784,525 11/1988 Francois ..... 405/190 X
5,044,827 9/1991 Gray et al. ..... 405/158 X
5,074,712 12/1991 Baugh ..... 405/158

*Primary Examiner*—Randolph A. Reese
*Assistant Examiner*—J. Russell McBee
*Attorney, Agent, or Firm*—Luther A. Marsh

[57] ABSTRACT

The inspection of underwater structures and the repair of leaking cracks or joints therein is effected by the use of a platform positionable at the work site and supporting an equipment cart movable therealong with the cart carrying an underwater light and television camera system for viewing the site and a number of tools for cleaning the site, injecting a leak detecting dye thereon and injecting a sealant to close the cracks or joints. Movement of the equipment cart and operation of the tools are remotely controlled, preferrably with air motors.

19 Claims, 3 Drawing Sheets

REMOTE CONTROLLED UNDERWATER JOINT AND CRACK SEALING

The present invention pertains to the inspection and repair of underwater structures and, more particularly, to the use of remotely controlled equipment for effecting such inspections and repairs.

BACKGROUND OF THE INVENTION

Underwater structures such as dams, spillways, stilling basins, draft tubes and other hydraulic structures may, over time, develop leaks which require repair. As direct access to the areas in need of maintenance frequently is difficult, such repair procedures are arduous and expensive. Underwater joint and crack repairs commonly involve cleaning of the involved area, identification of the leaks and grouting to seal the same.

It is the primary object of the present invention to provide a techology which permits the inspection and repair of underwater structures by remote control.

It is also an object of the present invention to provide such a technology usable with underwater structures which are inaccessable by conventional inspection and repair techniques.

SUMMARY OF THE INVENTION

The above and other objects of the present invention which will become apparent hereinafter are achieved by the provision of apparatus for the remote inspection and repair of underwater structures which apparatus includes a main platform adapted to be positioned by a crane or the like at the location at which inspection and repair is to be performed; an equipment cart supported by and movable in a horizontal direction along the platform; underwater lights and television camera mounted on the cart for remote viewing of the work location; and a plurality of remotely controlled tools also mounted on the cart and operable to effect cleaning of the work location, location of leaking cracks or joints, and grouting of such cracks or joints. Preferrably, movement of the cart along the platform is effected by a threaded drive shaft driven by an air motor. The remotely controlled tools may include a rotary brush driven by an air motor, a surface scraper with water blasting nozzle and injection nozzles for applying a leak detecting dye to the work surface and grouting material to seal the cracks or joints. The grouting material may be a water activated polyurthane forming joint sealant.

For a more complete understanding of the invention and the objects and advantages thereof, reference should be had the accompanying drawings and the following detailed description wherein a preferred embodiment of the invention is illustrated and described in detail.

DESCRIPTION OF THE PREFERRED EMBODIMENT

Figure 1:
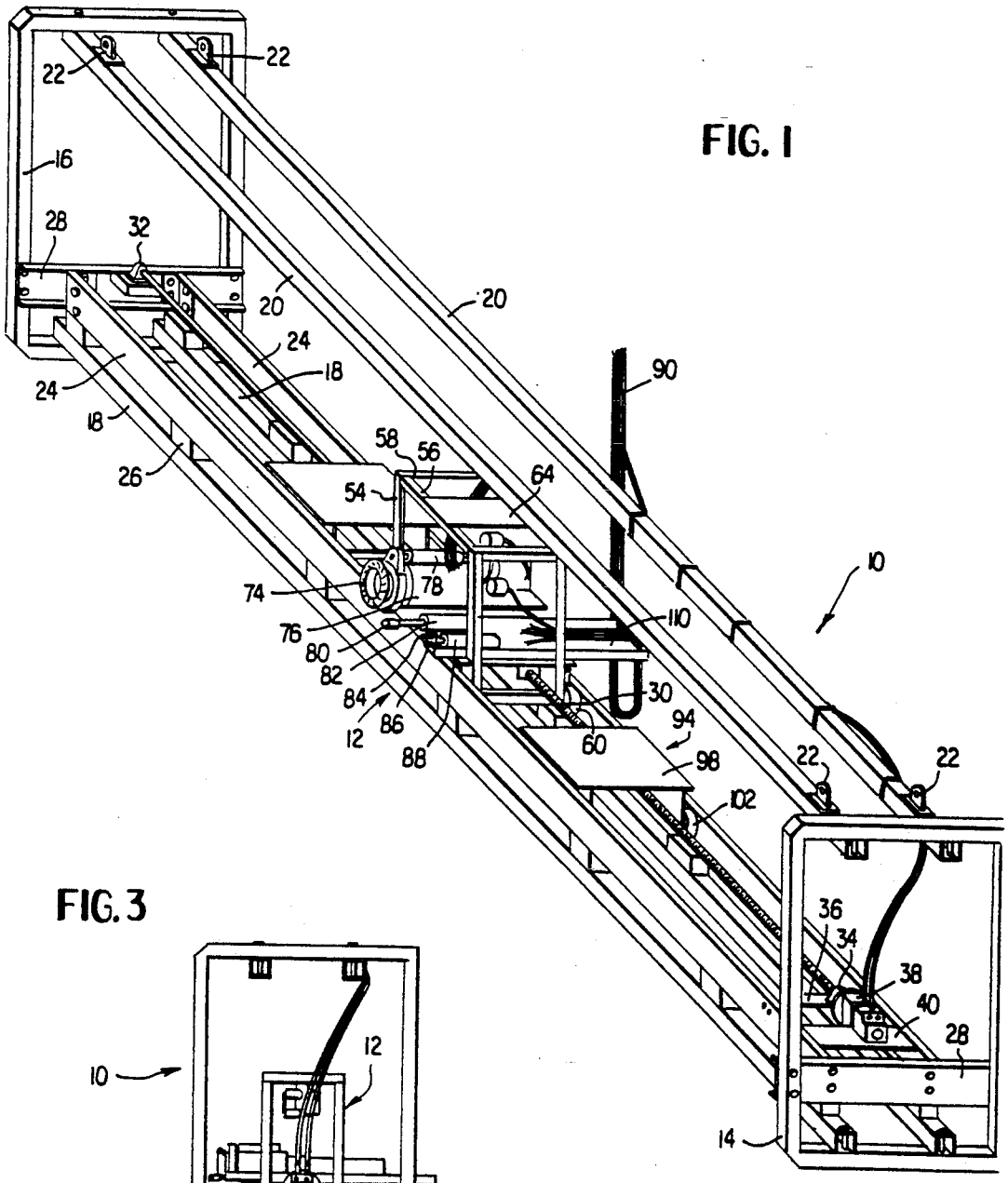
FIG. 1 is an isometric view of the work platform and equipment cart of the present invention.

The equipment utilized in effecting underwater repairs in accordance with the present invention is illustrated in the accompanying drawings and includes a main platform, designated generally by the reference numeral 10, adapted to be suspended at the work zone, and an equipment cart, designated generally by the reference numeral 12, carrying underwater viewing equipment and a number of remotely controlled tools for effecting repairs, the cart 12 being movable along the main platform 10.

The main platform 10 is formed of a pair of end frames 14, 16 fabricated of metal tubing and of generally rectangular configuration, a pair of lower tubes or framing members 18 and a pair of upper tubes or framing members 20 each extending between and connected to the two end frames, the upper tubes 20 being provided, adjacent each end thereof, with lifting eyes 22 for receiving lifting cables (not shown). A pair of metal channel beams 24 located vertically above the lower tubes 18 and connected thereto by spacers 26 extend the length of the platform and are also connected by cross rails 28 to the end frames. The flanges of each of these channel beams face those of the other to provide support and guide rails for the equipment cart 12. A drive shaft 30 extends the length of the work platform, being journalled at one end by a pillow block bearing 32 affixed to the cross rail 28 and, adjacent the opposite end, by a second pillow block bearing 34 affixed to a support plate 36 mounted on the channel beams 24. The shaft between the two pillow block bearings is threaded, for example with 5 pitch Acme threads. An air motor 38, mounted on a support plate 40 connected to the channel beams 24 is coupled to the end of the shaft extending through the bearing 34 by a flexible drive shaft coupler 42.

Figure 3:
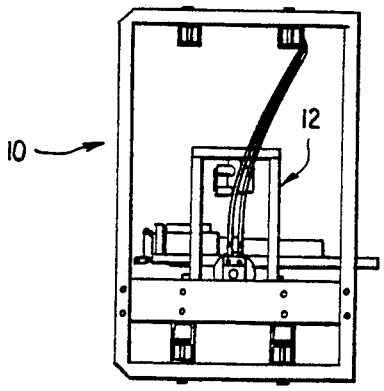
FIG. 3 is a side elevational view thereof.
Figure 7:
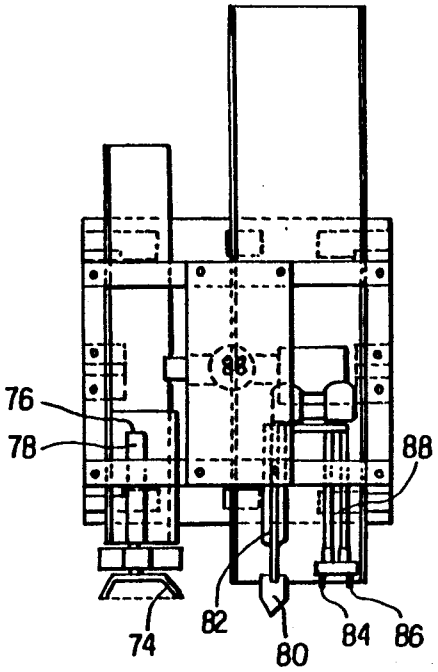
FIG. 7 is a top plan view of the equipment cart.
Figure 6:
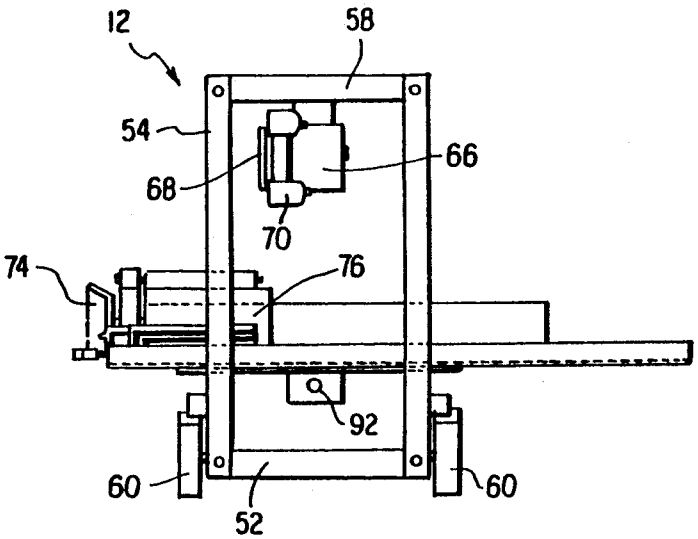
FIG. 6 is a side elevational view of the equipment cart.
Figure 5:
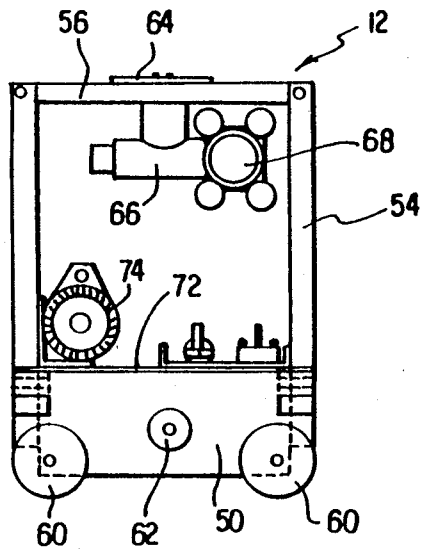
FIG. 5 is a front elevational view of the equipment cart separate from the work platform and on an enlarged scale relative to the proceeding figures.
Figure 4:
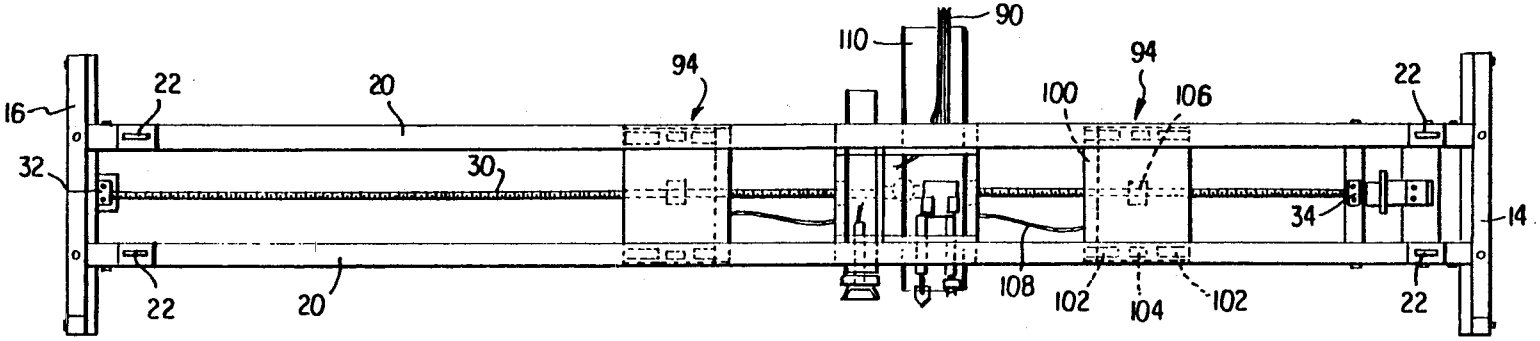
FIG. 4 is a top plan view thereof.
Figure 2:
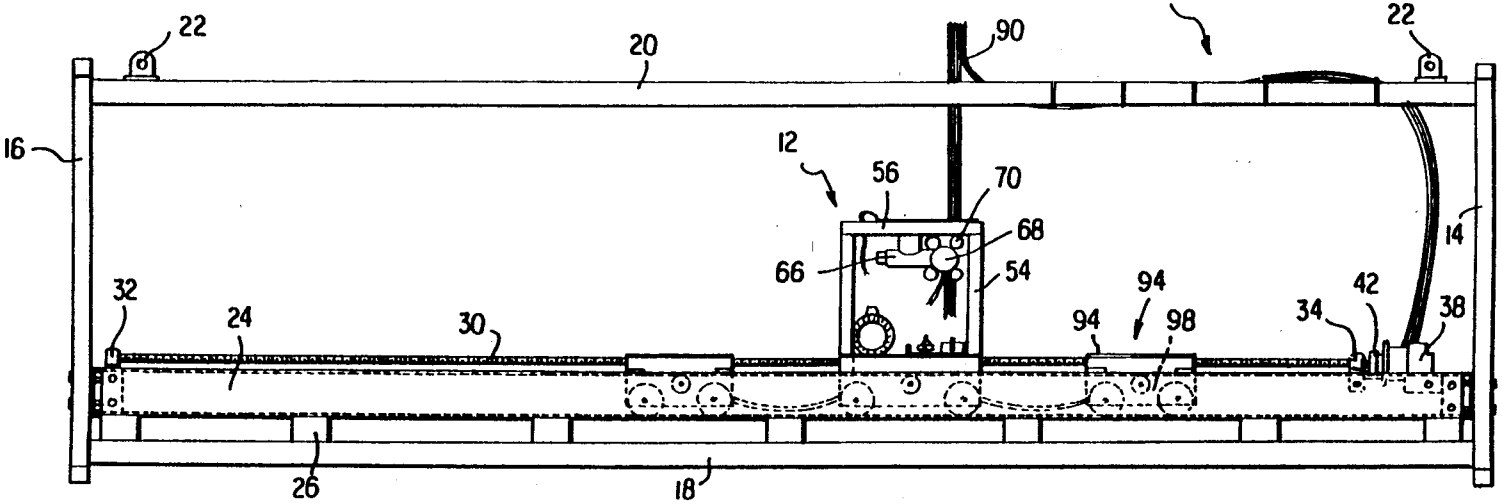
FIG. 2 is a front elevational view thereof.

The equipment cart 12, as is shown most clearly in FIGS. 5, 6 and 7, includes a pair of side plates 50 connected by lower cross bars 52 to form a rectangular base, a vertical bar 54 connected to and extending upwardly from each corner of the base and upper side and cross bars 56, 58, respectively, joining the upper ends of the vertical bars. The cart 12 is provided with main or supporting wheels 60 and stabilizer wheels 62. As is shown in FIG. 3, the main wheels 60 bear on the lower flanges of the channel beams 24 while the stabilizer wheels 62 engage the upper flanges. An upper mounting plate 64 is connected to and extends between the upper side bars 56. Attached to the underside of the plate 64 is a camera and light mount unit 66 having pan and tilt capabilities which, in turn, carries an underwater video camera 68 and an array of underwater lights 70. A lower mounting plate 72 supported by and connected to the side plates 50 provides a base for a number of tool mechanisms including, for example, a rotary brush 74 driven by an air motor 76 and movable transversely of the cart by an air cylinder 74, a scraper (with water blasting nozzle) 80 movable by an air cylinder 82, and dye and grout dispensing hoses or nozzles 84, 86, the two nozzles being movable as a unit by an air cylinder 88. Each of the air-powered components of the system is connected, by suitable air hoses, to air supply and control means (not shown) located remotely from the platform, these hoses and the electrical power supply and video cables for the camera mount, camera and light units forming an umbilical cord 90 extending from the platform to the remote location. A drive shaft nut 92, which is threaded to receive the drive shaft 30, is secured to the underside of the lower mounting plate 72.

As the length of the platform, for example twenty feet, is substantial, it is desirable to provide additional support in addition to the pillow block bearings 32, 34 for the drive shaft 30 to prevent excessive flexing thereof. To this end there are provide a pair of shaft support carts, designated generally by the reference numeral 94, one support cart being located on each side of the equipment cart 12. Each of the support carts 94 includes a top plate 96, a pair of side plates 98 and cross bars 100; and each support cart 94 is provided with main wheels 102 for engaging the lower flanges of the channel beams 24, stabilizer wheels 104 for engaging the upper flanges, and a guide block 106 affixed to the underside of the top plate, the guide block 106 having a smooth through bore receiving the drive shaft 30. Each of the support carts is connected to the equipment cart by a length of steel cable 108. While not illustrated, limit switches may be provided near the ends of the channel beams.

Completing the description of the apparatus, a hose tray 110 is connected to and projects rearwardly from the equipment cart so as to maintain the unbilical cord 90 clear of the platform frame at all times.

The above described equipment is used for the inspection and repair of underwater structures. In such use, the platform 10, supported by lift cables, is lowered, for example by a crane, to the area of interest of the structure with the front or working side of the platform, that which includes the camera and tool mechanisms, facing the structure. The work surface is first cleaned with the rotary brush 74 and/or the scraper with water blasting nozzle 80 while the equipment cart 12 is moved horizontally along the platform 10 so that these tools transverse the work surface. The camera 68 and lights 70 allow remote visual inspection and monitoring throughout the procedure. Following surface cleaning, the dye nozzle is advanced and a leak detection dye is injected onto the work surface. When leaking cracks or joints are detected, the grout nozzle 84 is advanced to apply sealant thereto. The sealant is, preferrably, a water activated polyurethane forming sealant.

While a preferred embodiment of the invention has been illustrated and described in detail, it will be appreciated that changes and additions may be had therein and thereto without departing from the spirit of the invention. Reference should, accordingly, be had to the appended claims in determining the true scope of the invention.

What is claimed is:

1. Apparatus for use in effecting underwater repairs at a work site comprising;

a main platform;

an equipment cart supported by and movable along said main platform;

underwater viewing apparatus connected to said equipment cart; and tool means for effecting underwater repairs at said work site connected to the equipment cart;

wherein said main platform rotatably supports a threaded drive shaft;

said equipment cart is connected to a drive shaft nut receiving said threaded drive shaft; and a motor is supported on the main platform, the motor being rotatably coupled to the drive shaft for rotating the shaft to drive the equipment cart along the main platform.

2. The apparatus of claim 1 wherein said main platform comprises:

a pair of end frames, each end frame fabricated from tubular members to form a generally rectangular configuration;

a pair of lower framing members extending parallel to one another between the pair of end frames, each lower framing member being connected to both of the end frames; and a pair of upper framing members extending parallel to one another between the pair of end frames, each upper framing member being connected to both of the end frames.

3. The apparatus of claim 2 further comprising:

a pair of cross rails, one cross rail connected to each of the end frames;

a plurality of spacers disposed and connected at predetermined intervals along the length of the pair of lower framing members; and a pair of flanged channel beams located vertically above the lower framing members and connected to the spacers, the flanges of the channel beams facing one another to provide a guide and support for the equipment cart.

4. The apparatus of claim 3 wherein the equipment cart comprises:

a rectangular base having four corners and formed by a pair of side plates connected to a pair of lower cross bars;

a vertical bar connected to and extending upwardly from each corner of the base; and a pair of upper side and a pair of upper cross bars connected to and joining the upward vertical extensions of the vertical bars.

5. The apparatus of claim 4 wherein the flanges of the channel beams include upper flanges and lower flanges, and said equipment cart further comprises a plurality of main supporting wheels and a plurality of stabilizer wheels, said main supporting wheels bearing on and riding along the lower flanges of the channel beams and the stabilizer wheels engaging the upper flanges of the channel beams.

6. The apparatus of claim 5 further comrising an upper mounting plate connected to and extending between said upper side bars of the equipment cart, a camera and light mount unit attached to the upper mounting plate, said camera and light mount unit having pan and tilt capabilities, and an underwater video camera and underwater lights attached to the camera and light mount unit.

7. The apparatus of claim 5 further comprising a lower mounting plate supported by and connected to said side plates of the equipment cart, wherein said tool means for effecting underwater repairs are supported by said lower mounting plate.

8. The apparatus of claim 7 wherein said tool means includes a rotary brush operatively connected to an air motor, said rotary brush being mounted on said mounting plate for movement transversely of the cart by an air cylinder.

9. The apparatus of claim 8 wherein said tool means includes a scraper operatively connected to and movable by an air cylinder.

10. The apparatus of claim 9 wherein said tool means includes dye and grout dispensing nozzles, the two nozzles being operatively connected to and movable as a unit by an air cylinder.

11. The apparatus of claim 10 further comrising an upper mounting plate connected to and extending between said upper side bars of the equipment cart, a camera and light mount unit attached to the upper mounting plate, said camera and light mount unit having pan and tilt capabilities, and an underwater video camera and underwater lights attached to the camera and light mount unit.

12. The apparatus of claim 11 further comprising an umbilical cord containing required air and electrical power supply lines connected to the equipment cart and extending above the surface of the water, and a hose tray connected to and projecting rearwardly from the equipment cart so as to maintain the unbilical cord clear of the main platform.

13. The apparatus of claim 8 wherein said tool means includes dye and grout dispensing nozzles, the two nozzles being operatively connected to and movable as a unit by an air cylinder.

14. The apparatus of claim 7 wherein said tool means includes a scraper with water blasting nozzle operatively connected to and movable by an air cylinder.

15. The apparatus of claim 14 wherein said tool means includes dye and grout dispensing nozzles, the two nozzles being operatively connected to and movable as a unit by an air cylinder.

16. The apparatus of claim 7 wherein said tool means includes dye and grout dispensing nozzles, the two nozzles being operatively connected to and movable as a unit by an air cylinder.

17. The apparatus of claim 5 further comprising a pair of shaft support carts supported by and movable along the main platform, one support cart located on each side of the equipment cart for the prevention of excessive flexing of the drive shaft, each support cart being connected to the equipment cart by a length of steel cable, and wherein each support cart further comprises a plurality of main supporting wheels and a plurality of stabilizer wheels, said main supporting wheels bearing on and riding along the lower flanges of the channel beams and the stabilizer wheels engaging the upper flanges of the channel beams.

18. The apparatus of claim 1 further comprising a pair of shaft support carts supported by and movable along the main platform, one support cart located on each side of the equipment cart for the prevention of excessive flexing of the drive shaft, each support cart being connected to the equipment cart by a length of steel cable.

19. The apparatus of claim 18 wherein each support cart comprises a top plate, apair of side plates, each of which is connected to the top plate, and a pair of cross bars, each of which is connected to both of the two side plates.

* * * * *